US005515125A

United States Patent [19]

Gerver

[11] Patent Number: 5,515,125

[45] Date of Patent: May 7, 1996

[54] STORAGE CART FOR INSTRUCTIONAL DEVICES

[76] Inventor: Robert Gerver, 20 Knob Hill Dr., Kings Park, N.Y. 11754

[21] Appl. No.: 340,037

[22] Filed: Nov. 14, 1994

[51] Int. Cl.[6] ..... G03B 21/00

[52] U.S. Cl. ..... 353/122; 353/119; 312/10.1

[58] Field of Search ..... 353/119, 72, 122; 348/836, 838, 839, 843; 312/7.2, 9.1, 10.1, 9.55, 9.56, 9.64, 9.41, 9.42

[56] References Cited

U.S. PATENT DOCUMENTS

| | | | |
|---|---|---|---|
| 3,207,029 | 9/1965 | Field et al. | 353/119 |
| 3,471,947 | 10/1969 | Geuser | 312/10.1 |
| 4,836,786 | 6/1989 | Wong | 353/DIG. 3 |

*Primary Examiner*—William C. Dowling

*Attorney, Agent, or Firm*—Brumbaugh, Graves, Donohue & Raymond

[57] ABSTRACT

A lockable storage cart for an overhead projector and a calculator viewscreen for a graphics calculator viewscreen for a graphics calculator has a flat top surface with an opening to permit entry of the projector and viewscreen which rest on a flat bottom surface. The vertical arm and reflector of the overhead projector extend above the top surface to project an image from the calculator viewscreen and/or overhead projector onto a projection screen. A cover closely fits the opening in the top surface and is lockable, so as to prevent unauthorized removal of the contents of the cart. The sides of the cart are made of wire mesh to allow free flow of cooling air and the cart is provided with legs and casters to allow ready movement. Alternatively, the legs and casters may be removed and the cart permanently installed by straddling spaced-apart desks or tables.

9 Claims, 2 Drawing Sheets

STORAGE CART FOR INSTRUCTIONAL DEVICES

FIELD OF THE INVENTION

This invention relates to a storage cart for instructional devices used in schools and more particularly to a cart having a lockable housing for accommodating an overhead projector and a graphics viewscreen for a graphics calculator. The housing provides secure storage for the devices when not in use during periods of instruction. The construction of the cart facilitates easy transport between classrooms and reduces set-up time in schools in which the instructional devices are shared among several rooms. Its unique construction allows simultaneous use of a classroom chalkboard by reducing obstruction by the overhead projector, and by enabling projection of the image on to a screen mounted above the blackboard.

BACKGROUND OF THE INVENTION

Graphics calculators provide extensive information that allows for the analysis of mathematical functions and their graphs. These graphs are displayed along with related information on the calculator's display. This type of calculator also allows the user to investigate statistics, matrices, and many other mathematical processes. They can be programmed by the user to perform customized analyses. They have already had a significant impact on mathematics education on the high school and college levels.

Graphics calculators have quickly become a staple in American high schools. In their 1989 publication *Curriculum and Evaluation Standards for School Mathematics*, the National Council of Teachers of Mathematics recommended the incorporation of graphics calculators in all "core" high school mathematics courses. As a learning tool, the graphics calculator gives students the power to investigate mathematical patterns, improve reasoning and make original conjectures. As a teaching tool, the calculator allows the teacher to make connections to real life data, and rely less on contrived problem scenarios that could be solved easily by hand.

To adapt the graphics calculator to the instructional setting, graphics calculator manufacturers began offering viewscreens that could project the calculator's display onto a screen for classroom use. The typical calculator viewscreen is essentially the display of an associated calculator, larger in size than the display on the calculator keypad. The viewscreen is basically transparent and the data or graphics generated by the associated calculator on the viewscreen are opaque. The viewscreen thus functions as a slide or transparency when placed on the lighted surface of an overhead projector and the data or graphics are projected onto the screen. An example of such a calculator viewscreen is the viewscreen manufactured for the Texas Instruments Model TI-82 graphics calculator.

In typical classroom usage, the instructor must first set up the overhead projector on a desk or other surface, then place the calculator viewscreen on the projector and connect the various A.C. line cords to power outlets and the calculator keypad unit to the viewscreen. At the conclusion of the lesson, the various units must be disassembled and moved to another classroom or into storage areas. This excessive movement infringes on class time. Teachers may not truly integrate the calculator into appropriate daily class activities because of the set-up and break-down time required. The frequent set-up and breakdown also makes the expensive equipment susceptible to damage. The fragility of the viewscreen and its cost require that it must be safely stored away when not in use. Consequently, it is difficult to fully utilize the capabilities of the viewscreen in classroom activities.

To avoid distortion, the plane of the screen on which the image from an overhead projector is projected should be perpendicular to the direction of projection. This is especially important when presenting graphical representations from a graphics calculator. Conventionally, in the classroom, the overhead projector is put on a desk and the calculator viewscreen positioned on the lighted plate of the projector. The projection screen is usually of the "window-shade" type that pulls down over the chalkboard at the front of the room. The combined bulk of the overhead projector and the calculator viewscreen often blocks the view of the image for many students in the classroom. Simply raising the projection screen yields a distorted graph that is partially out of focus. Even when the projection screen is not in use, view of the chalkboard is impeded by the overhead projector and calculator viewscreen, which then must be removed and placed somewhere else. The necessary movement of the fragile viewscreen and projector, with their trailing electrical cords can lead to accidents. Consequently, shifting from boardwork to the calculator display, the quintessence of integration of these materials, becomes cumbersome and distracting.

It is therefore desirable to provide a piece of equipment that will facilitate the easy, frequent and shared use of a calculator viewscreen and overhead projector by minimizing or eliminating the problems associated with their use.

SUMMARY OF THE INVENTION

To achieve these ends, the invention provides a storage cart that houses the overhead projector, the graphics calculator viewscreen, and all accompanying electrical cords and materials. The projector and viewscreen remain set-up at all times, ready for immediate use. The cart is lockable, eliminating the need to move the components to a secure area when not in use, and is readily transportable from room to room, as needed.

The cart sits low, so the overhead/viewscreen combination will not significantly block the classroom chalkboard. The cart is provided with a removable, lockable lid, which can serve as extra desk space when the viewscreen projector is not in use. The underside of the lid may include instructions on the use of the apparatus and a teacher sign-up sheet, to tell a user where and when the apparatus is needed next. The cart can be locked and wheeled to its next designated location, already set up for the instructor to plug in and use.

A multi-outlet power strip is provided within the cart to allow the viewscreen and projector to remain plugged in, with only a single electrical cord to be plugged in to the A.C. supply.

Removable legs and casters are provided for the cart. If the apparatus is permanently assigned to one room, the casters can be removed. In such rooms where there are two instructor desks or tables of the same height, the cart can straddle the two desks and remain in position permanently. In this case, the legs can be removed as well.

BRIEF DESCRIPTION OF THE DRAWINGS

The features and advantages of the invention will become apparent from the following detailed description thereof, when taken in conjunction with the appended drawings in which.

DETAILED DESCRIPTION OF THE INVENTION

Figure 1:
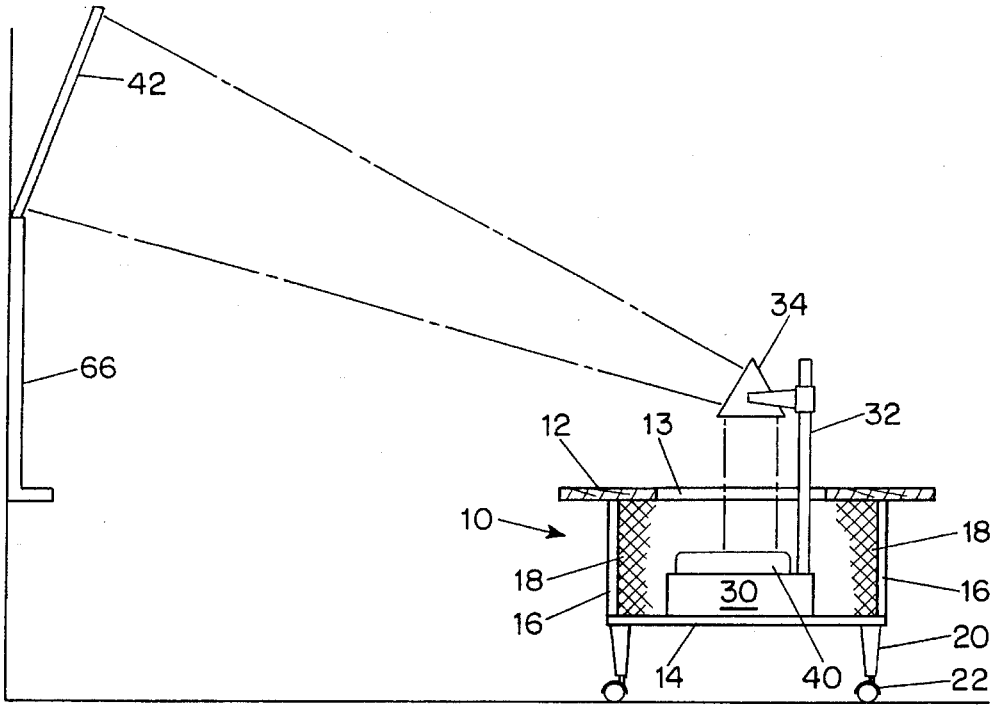
FIG. 1 illustrates use of the invention in a typical classroom application, with the cart partially cut away to show the arrangement of the interior components.

Referring now to the drawings, FIG. 1 shows the arrangement according to the invention is shown as used in a classroom or meeting room.

Figure 2:
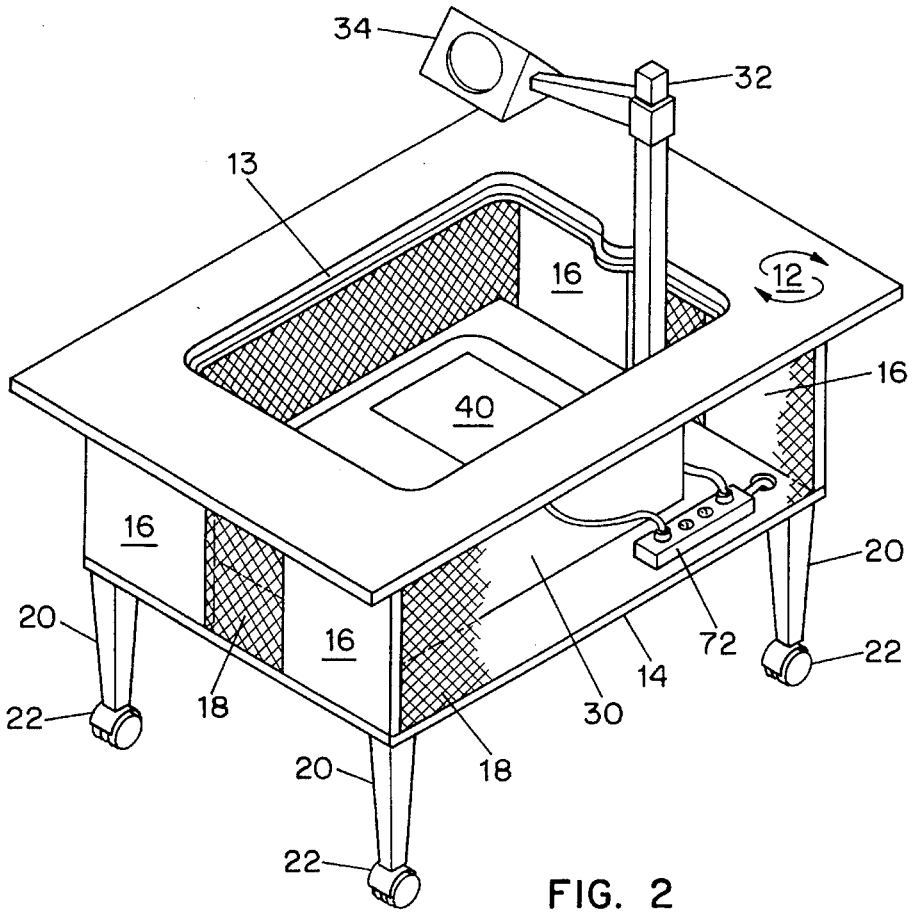
FIG. 2 is a perspective view of the cart of the invention.

The cart 10 has a generally rectangular flat top 12 formed of a rigid material such as plywood or plastic laminated flakeboard, and a bottom 14, of similar material. The front and rear of the cart are each formed of a pair of separated solid panels 16 (FIG. 2). The sides and the spaces between the panels of the front and rear of the cart are formed of rigid wire mesh 18 to allow free air circulation through the cart.

The top 12, bottom 14, end panels 16 and wire mesh 18 are assembled with conventional fastening means, e.g. screws, glue, angle brackets, staples, etc. to form the rectangular, box-like housing as shown.

The cart may be mounted on legs 20 which support the top 12 at desk height and may be readily removable if desired. The legs may be provided with casters 22 to enable ready movement of the unit from room to room.

A conventional overhead projector 30 is contained within the cart, resting on the bottom 14. The top of the cart 10 is provided with an opening 13, generally rectangular in shape, and large enough to permit the projector unit to be placed on the bottom 14 of the cart and to accommodate the vertical arm 32 of the projector which carries the reflector unit 34.

As thus far described, the overhead projector may be used in its normal way, e.g., to project transparencies placed on its lighted upper surface, via the reflector 34, to a screen. When used to display images from a graphics calculator, the calculator viewscreen 40 is placed on the lighted surface of the overhead projector and the reflector unit adjusted to reflect the image on a screen 42, as illustrated in FIG. 1.

Figure 3:
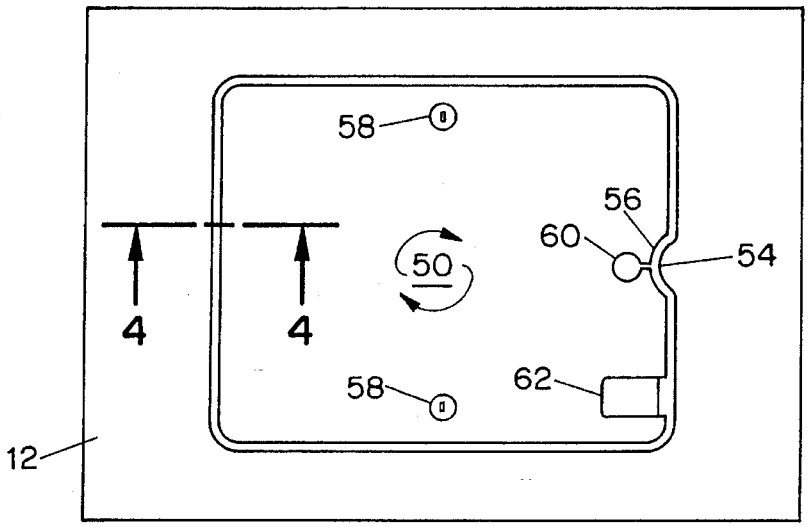
FIG. 3 is a plan view of the cart of the invention showing the lockable cover in place.
Figure 4:
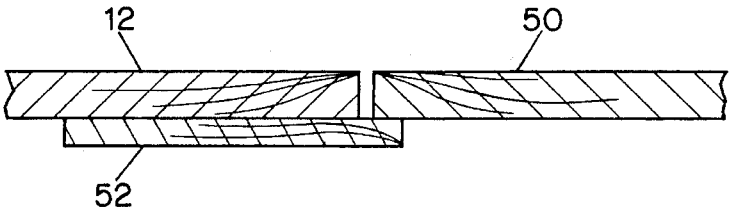
FIG. 4 is a partial cross-section through the top and cover of the cart, taken along the lines 4—4 of FIG. 3.

For protection and security of the overhead projector and calculator viewscreen when not in use, a lockable cover 50 is provided, as shown in FIG. 3. The cover, preferably formed of the same material as the top, is shaped to fit the opening with just enough clearance to permit easy insertion and removal and rests on a flange 52 provided along the bottom edge of the opening 13, see FIG. 4. The opening and cover are formed with complementary finger 54 and notch 56 to facilitate the orientation of the cover when putting it in place. Cabinet locks 58 secure the cover against unauthorized removal. Finger hole 60 allows for ready removal of the cover and rectangular opening 62 accommodates the vertical arm 32 of the overhead projector. If desired, the arm 32 may be unfastened from the projector unit and stored, with the reflector unit 34, in the housing when not in use.

Suitable fastening means, such as elastic or Velcro straps (not shown) may be provided on the interior surfaces of the panels 16 to hold the calculator unit, pointer, instruction book, etc. Also, a multi-outlet strip 72 with a single connection to a power source, is provided (FIG. 2) to accommodate the power cords for the units 30 and 40 and avoid a wiring snarl outside of the cart.

Preferably, as shown in FIG. 1, the reflector of the overhead unit is positioned such as to project the image at an upward angle to a viewing screen. In a classroom, the viewing screen 42 would be positioned above the conventional chalkboard 66 and angled so as to be perpendicular to the direction of projection of the image, thereby avoiding distortion. Preferably, the screen would be made of lightweight foamcore board and would have imprinted on it, alongside the viewing area, an enlarged representation of the graphics calculator keypad, to facilitate the teaching process.

Use of the invention allows the projector unit and the graphics viewscreen to be supported well below desktop level. As a consequence, only the reflector unit 34 projects above desk height and does not significantly obstruct the view of students in the classroom. Because the projected image is directed to the screen above the chalkboard, the instructor can use the chalkboard while the image is in full view of the students.

Figure 5:
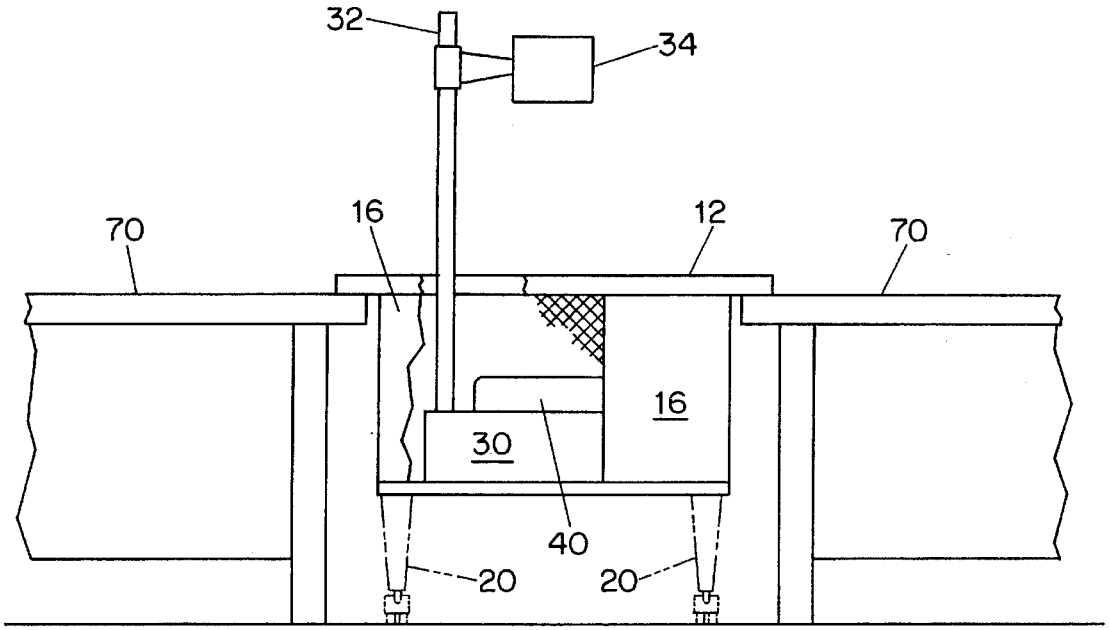
FIG. 5 is a view of the cart of the invention taken from the rear, showing its use when supported from spaced-apart desks and partially cut away to show its interior components.

As shown in FIG. 5, the box unit may be supported between two spaced apart desks or tables 70, near the front of a classroom, in which case, the legs are not used and may be removed, as indicated by the dotted lines. With the legs attached, the unit may be readily moved from classroom to classroom, as desired.

The lockable construction of the unit reduces the possibility of unauthorized removal of the graphics viewscreen or overhead projector, since they cannot be readily removed from the cart. Thus, the present need to store these units in a secure room or closet when not in use, is avoided. The cart, with its cover locked in place, may be left in the classroom at the end of class.

Although the invention has been described as used in a classroom, as noted above, it is equally suited for use in offices, hotels, conference rooms, etc., wherever a secure, portable housing for an overhead projector and/or graphics viewscreen is required. Various modifications in the construction of the invention will occur to those skilled in the art and the scope of the invention is to be limited only as set forth in the appended claims.

I claim:

1. A storage cart for an instructional device comprising an overhead transparency projector usable with calculator viewscreen comprising:

a housing having a top, a bottom, end and sidewalls forming a hollow, generally rectangular, box-like structure;

an opening in said top of a size and shape to permit placement of said instructional device on the bottom of said housing;

a cover adapted to closely fit in said opening with its upper surface in substantially the same plane as the upper surface of said top with said instructional device in said housing; and means for maintaining the upper surface of said top substantially at desk height, wherein the top and bottom of said housing are formed of rigid sheet material and said side walls are formed of wire mesh.

2. The storage cart of claim 1 wherein said end walls are formed at least in part of rigid sheet material, any portion of said end walls not formed of rigid sheet material being formed of wire mesh.

3. A storage cart for an overhead transparency projector having a horizontal lighted surface, a vertically extending arm and a reflector unit adjustably mounted on said arm, comprising:

a housing having a top, a bottom, end and sidewalls forming a hollow, generally rectangular, box-like structure;

an opening in said top of a size and shape to permit placement of said projector on the bottom of said housing, a removable cover adapted to closely fit in said opening with its upper surface in substantially the same plane as the upper surface of said top with said projector in said housing, said cover having a cut-out to permit the vertical arm of said projector to extend therethrough when said cover is fit in said opening; and means for maintaining the upper surface of said top substantially at desk height.

4. The storage cart of claim 3 further comprising lock means for securing said cover to said top when in place to prevent unauthorized access to the interior of said housing.

5. The storage cart of claim 4 wherein said top is provided with a finger extending into said opening and said cover is provided with a notch for receiving said finger, whereby proper orientation of said cover in said opening is assured.

6. The storage cart of claim 3 wherein said means for maintaining the upper surface of said top substantially at desk height comprises a plurality of legs affixed to the bottom of said housing and extending downwardly therefrom.

7. The storage cart of claim 3 wherein said top is generally rectangular in shape and substantially larger than said bottom, said top extending beyond both side walls, the extending portions of said top being adapted to rest on spaced apart desk-height surfaces to support said housing therefrom and maintain the upper surface of said top substantially at desk height.

8. In combination, an overhead transparency projector having a horizontal lighted surface, a vertically extending arm and a reflector unit adjustably mounted on said arm;

a calculator viewscreen adapted to have displayed thereon graphics generated by a calculator associated therewith, said calculator viewscreen being disposed on the lighted surface of said overhead transparency projector whereby said graphics are projected onto a projection surface; and a storage cart for retaining said projector and viewscreen in operative position, said storage cart comprising:

a housing having a top, a bottom, end and sidewalls forming a hollow, generally rectangular box-like structure;

an opening in said top of a size and shape to permit placement of .said projector and viewscreen on the bottom of said housing, said end and sidewalls extending to a height above the upper surface of said viewscreen, whereby only the vertical arm and reflector unit of said projector extends above said top;

a cover adapted to closely fit in said opening with its upper surface in substantially the same plane as the upper surface of said top with said projector and viewscreen in said housing, said cover having a cut out along one edge to permit the vertical arm of said projector to extend therethrough when said cover is fit in said opening; and means for maintaining the upper surface of said top substantially at desk height.

9. The combination of claim 8 further comprising lock means for securing said cover in said opening.

* * * * *